United States Patent [19]

Baysinger

[11] 4,181,235

[45] Jan. 1, 1980

[54] LIQUEFIED NATURAL GAS TANK CONSTRUCTION

[75] Inventor: Frank R. Baysinger, Pleasanton, Calif.

[73] Assignee: Kaiser Aluminum & Chemical Corporation, Oakland, Calif.

[21] Appl. No.: 868,014

[22] Filed: Jan. 9, 1978

[51] Int. Cl.[2] ..... B65D 7/04; B65D 7/38

[52] U.S. Cl. ..... 220/5 A; 114/74 A; 220/1 B; 220/901; 228/184

[58] Field of Search ..... 220/1 B, 5 A, 901; 114/74 A; 29/469; 228/184; 113/120 S; 52/80, 245

[56] References Cited

U.S. PATENT DOCUMENTS

| | | | |
|---|---|---|---|
| 929,542 | 7/1909 | Boermel | 137/593 X |
| 2,380,089 | 7/1945 | Ulm | 220/1 B |
| 2,487,786 | 11/1949 | Bogle | 220/1 B X |
| 2,684,528 | 7/1954 | Rossheim et al. | 228/184 X |
| 2,731,334 | 1/1956 | Wissmiller et al. | 228/184 X |
| 2,869,749 | 1/1959 | Arne et al. | 222/1 B |
| 3,677,021 | 7/1972 | Bognaes et al. | 114/74 A X |
| 3,793,145 | 2/1974 | Jordan et al. | 220/5 A X |
| 3,921,555 | 11/1975 | Sazuki et al. | 113/120 S X |
| 3,945,236 | 3/1976 | Hooper | 228/184 X |
| 3,968,764 | 7/1976 | Kuamsdal et al. | 114/74 A |

FOREIGN PATENT DOCUMENTS 3356 of 1914 United Kingdom ..... 220/5 A

OTHER PUBLICATIONS

"LNG Carriers–The Current State of the Art", by William duBarry Thomas, (11–12–71), can be obtained from Society of Naval Architects and Marine Engineers, 74 Trinity Place, N.Y., N.Y. 10006.

"A Solution to the Series Production of Aluminum LNG Spheres", by P. Takis Voliotis (11–12–77), can be obtained from Society of Naval Architects and Marine Engineers, 74 Trinity Place, N.Y., N.Y. 10006.

Brochure by The Kawasaki Heavy Industries Limited, "LNG Carrier", (Publishing Date Unknown), 2–4–1 Hamamatsu–choi Minato–tu, Tokyo, Japan.

*Primary Examiner*—Allan N. Shoap

*Attorney, Agent, or Firm*—Paul E. Calrow; John S. Rhoades

[57] ABSTRACT

Improved method for manufacturing spherical cryogenic liquid holding tanks as well as the tanks produced thereby, wherein at least the major hemispherical portions of such tanks are formed from curvilinear elongated quadralateral plate members which in the case of a given tank each have substantially the same arcuate minor axis dimensional width when measured at the midpoint of the arcuate major axis but varying lengths. These plate members of varying lengths are initially selectively arranged and secured to each other to form a series of substantially symmetrical and uniformly dimensioned, individual, triangular spherical tank sectors or modules. These spherical sectors or modules are subsequently secured to each other such that the longest plate member of a given sector is located adjacent or in close proximity to the tank's equator while the midpoints of the major axes of the various plate members in such a spherical sector are located in substantially parallel relationship to each other and the tank's equator in the finished tank structure.

13 Claims, 18 Drawing Figures

STATION A

STATION A

STATION C

STATION C

LIQUEFIED NATURAL GAS TANK CONSTRUCTION

BACKGROUND OF THE INVENTION

This invention relates to the transportation and/or storage of liquefied and/or compressed gases in bulk cargo tanks of spherical design. More particularly, it is concerned with providing an improved method for fabricating a metal, spherical, liquid and/or compressed gas storage tank and the structure resulting therefrom, wherein metal scrap losses are minimized and weldments reduced.

The worldwide energy demand for natural gas as well as inexpensive and efficient means for storing and transporting this gas in the form of Liquefied Natural Gas (LNG) from one location to another is becoming more and more pronounced. During transport and storage in the liquid state, the natural gas is generally held in relatively large tanks and at a temperature of about minus 260° F. at approximately atmospheric pressure. This, in turn, has required transport and holding tanks to be of exceptionally rugged heavy metal plate construction including, in particular, tanks made either from expensive aluminum alloys or stainless and nickel alloy steels.

Depending on tank size and capacity, the aluminum plate material that is used can range, for example, anywhere from a thickness close to or approximating two inches at the equatorial belt and polar regions of the tank to slightly less than an inch in certain tank sections located intermediate the polar and equatorial belt areas. It is obvious, from the foregoing, that significant savings in the amount of metal used for the tank sections and the welding footage employed to join the tank sections of large tanks together can result in a reduction in cost of hundreds of thousands of dollars in the overall final tank fabrication.

The various problems involved in farbricating LNG tanks, includng spherical LNG tanks, and the relative merits of these tanks are discussed in considerable detail in a published paper presented by William du Barry Thomas et al to The Society of Naval Architects and Marine Engineers on Nov. 11–12, 1971. The title of this paper is "LNG Carriers—The Current State of the Art." The particular problems involved in fabricating and installing spherical LNG tanks within transport vessels are discussed in a published paper presented by P. Takis Veliotis at the Annual Meeting of The Society of Naval Architects and Marine Engineers in New York City, New York, on Nov. 10–12, 1977. This paper is entitled "A Solution to the Series Production of Aluminum LNG Spheres."

This latter article delineates the manufacturing techniques adopted and currently used by General Dynamics Corporation of Quincy, Massachusetts in its manufacture of spherical LNG tanks, and their installation on board ocean-going transport vessels including the present standard practice of so orienting the elongated plates with curvilinear marginal edges that make up the major areas of the hemispheres of the spherical tank that their long axes extend along longitudinal or vertical spherical tank lines. Because of this longitudinal line plate orientation and the fact that a given plate should ordinarily be thicker or heavier near the equator of the sphere and somewhat thinner in the areas intermediate the polar regions and the equator, the individual plates normally will have a tapered thickness with the thickest part of the plate being located more closely adjacent the equator. The aforesaid plate orientation and differential nonuniform thickness have resulted in the loss of a substantial amount of metal through scrappage due to the trimming and cutting required to fit the plate members together in the required sequence and vertical arrangements for a given tank sphere as well as substantial onsite welding costs.

In one effort to reduce costs, attempts have been made to systematize the flow of work and the attachment of the plates to each other in LNG spherical tank manufacture. This is illustrated, for example, in U.S. Pat. No. 3,921,555 granted Nov. 25, 1975. In the patented system, however, the plate members used in the hemispherical portions of the sphere have still been generally arranged with their long marginal edges being located along longitudinal or vertical spherical lines. Multiple individual plate members and extensive plate trimming operations are still required in such a system along with considerable welding footage.

Other attempts to reduce scrappage have involved producing spheres while using the expanded cube concepts, i.e., using spherical segments having a generally overall square configuration. While the expanded cube concept has had some measure of success in the production of small spherical tanks on the order of 30 feet in diameter and less, it is not feasible for producing the large spherical tanks for which the instant invention is particularly adapted because of the commercial unavailability and difficulties involved in producing the extremely large size square metal plates required for such tanks.

SUMMARY OF THE INVENTION

The present invention is directed to an improved method for fabricating a spherical LNG tank from metal plate members while selectively orienting the majority of the plate members making up the tank in an improved fashion as well as the tank produced by said method. More particularly, the present invention is concerned with fabricating the major sections or portions of the hemispherical segments of a spherical LNG tank from preformed arcuate, elongated, quadralateral plate members having curvilinear marginal side and end edges and varying lengths, but substantially the same curved minor axis dimensional width when measured at the midpoint of the curved major axis. This curved width dimension, in a preferred embodiment of the invention should also closely approximate the widths of the plate members in the flat or as initially rolled or fabricated condition in order to further reduce costs. Prior to assemblage into a sphere, the preformed quadralateral plate members of varying lengths are first arranged and permanently secured together in a plurality of individual, and generally spherical triangular sectors of substantially identical configurations and dimensions. The plate members of a given sector are so disposed relative to each other in the finished tank that the midpoints of the major axes of the sector's plate members are all located in generally parallel relation to each other and the tank's equator.

In the completed spherical tank, the triangular sectors are also preferably selectively geodesically oriented relative to each other on opposing sides of the sphere's equator or, when used, on opposing sides of an equatorial belt also made up of elongated curvilinear plate members. In this orientation, the longer or side marginal edge of each sector plate will be latitudinally disposed and parallel the equator of the sphere and at least certain of the end and side curvilinear marginal edges of the plate members of the various triangular sectors will be aligned with the common arcs of intersecting great circles drawn or projected along the surface of the sphere formed by the plate members making up the individual sectors and the equatorial belt when used.

Specially designed curvilinear polar cap members or calottes are used in the spherical tank assembly and when special curved plate members are used in the equatorial belt of the tank, these belt members are preferably made from curvilinear quadralateral plate members and preferably have the same curved minor axis dimensional width when measured across the midpoints of the curved major axis thereof as the plate members of the various triangular sectors. In those instances where the spherical LNG tank is constructed for installation on board an ocean going vessel, an equatorial ring of special configuration but well-known in the art can be incorporated in the equatorial belt design. This ring is made up of arcuate segments and, depending on its dimensions and other factors such as the size of the tank in which it is incorporated, may or may not necessitate changes in the ultimate dimensions of the adjacent equatorial belt plate members.

While simple land storage spheres that are devoid of an equatorial belt may be constructed and numerous different work flow fabricating and component assembly techniques and schemes may be used during practice of the instant invention, the invention will be described with particular reference to a shipboard tank assembly that utilizes an equatorial belt and ring. Assembly of the equatorial belt and ring components preferably takes place in one operation, while assemblies of the triangular sector components for the top and bottom hemispheres along with the various polar caps therefor involve other separate assembly operations. The finished tank hemispheres, equatorial belt and outer equatorial belt skirt used in attaching and anchoring the final sphere to a transport vessel are all brought together and assembled into the ultimate tank structure at a final assembly station.

The particular assembly of the individual spherical tank components including, in particular, the main hemispherical segments in the fashion to be described, has multiple advantages. These advantages include a substantial and noticeable reduction in scrap metal loss; welding of the majority of the components in a closed or weather-protected environment out of contact with dust, wind and moisture; a material decrease in welding footage and the costs incident thereto (because less pieces are welded); a noticeable reduction in vertical welding whereby the amount of filler metal per welding pass can be correspondingly increased to further decrease the welding man hours required per job as well as costs; and finally a reduction in sphere deformation problems due to weld shrinkage because less welding footage is required and most of the welding takes place in what is known in the art as a flat workpiece position.

Another advantageous feature of this invention involves more efficient control of the thickness of the spherical components and, in turn, tank cost control. As previously noted, the spherical components have different thicknesses depending upon their specific location on the sphere with the plate members making up the equatorial belt and polar caps or calottes usually having a greater thickness than the plate members located therebetween. Since the intermediate plate members function among other things as equator to pole thickness transition members, it has been the practice in the past to use intermediate plates that do not ordinarily have a uniform thickness along their lengths, but rather a tapered thickness with the thicker parts of such plates being located closer to the equator for strength reasons. Metal plates of tapered thickness, however, are difficult to manufacture with precision. Using the plate orientation system proposed, including arranging most of the hemispherical plates in the latitudinal fashion to be described retains substantially all of the thickness to strength relationships and advantages while avoiding the need for complex and intricately designed tapered plates as such.

In the preferred embodiments of the invention, the geodesic concepts disclosed in Richard Buckminster Fuller U.S. Pat. No. 2,682,235 are advantageously utilized in the arrangement of the quadralateral plate members in the equatorial and hemispherical portions of the tank. In this connection, it should be noted that the term "geodesic" has the meaning of pertaining to great circles of a sphere, or to arcs of such circles. Thus, a geodesic line as used in the specification and claims shall mean a line which is a great circle or arc thereof.

A preferred embodiment of the invention contemplates that the principal latitudinal great circle arcs of the spherical tank will coincide and match up with the joints between the longer sides of the curvilinear plate members making up the adjacent triangular sectors and the equatorial belt, when the latter is used. Thus, adjacent latitudinal great circle arcs will normally be separated or spaced apart by a curvilinear distance substantially equal to the curved minor axes' dimensional widths of the metal sector plates when measured at the midpoints of the curved major axes of the plates because, as noted heretofore, this midpoint dimensional width is substantially the same for all such sector plate members.

In summary, since the normal amount of spherical tank material and assembly steps have been substantially or materially reduced in the method and structure of the instant invention, it is anticipated that the finally fabricated and assembled spherical tanks employing the teachings of the instant invention should cost much less than the same spherical tanks size for size and when constructed in accordance with present day prior art practices.

The instant invention constitutes an improvement over the various schemes for manufacturing spherical tanks and incorporating them in transport vessels as illustrated, for example, in U.S. Pat. Nos. 3,841,269; 3,839,981; 4,013,030; 3,828,709; 3,841,253; 3,712,257; 3,770,158; 3,680,323, in addition to the aforementioned expanded cube concepts, the disclosure of U.S. Pat. No. 3,921,555 and the sphere production techniques mentioned in the P. Takis Veliotis article.

BRIEF DESCRIPTION OF THE DRAWING

FIG. 2(*a*) discloses the generally flat configuration of the elongated subsequently compoundly curved and latitudinally disposed, quadralateral plate members of the instant invention used in the construction primarily of the hemispheres of a spherical tank having the same basic overall dimensions as that made from the plate members of FIG. 2, and with the relatively small amount of scrap lost at the various corners thereof due to the cutting, trimming and fitting required to integrate the same in the tank structure also being shown in outline;

FIG. 4(*a*) is a cross-sectional view taken within the circumscribing circle 4(*a*) of FIG. 4;

FIG. 5(*a*) is an enlarged broken perspective view of a typical equatorial ring for a spherical tank taken within the circumscribing circle 5(*a*) of FIG. 5;

FIG. 7(*b*) illustrates the type of welded joint that can be used to secure together the plate members making up the sphere of FIGS. 7 and 7(*a*);

FIG. 7(*c*) is an enlarged cross-sectional view of the top of the tank shown in FIG. 7 and illustrates the differential thickness of various portions of the sphere made from the plate members of the instant invention.

FIG. 8(*b*) illustrates the type of welded joint that can be used to secure together the plate members making up the spheres of FIGS. 8 and 8(*a*);

DETAILED DESCRIPTION

Figure 1:
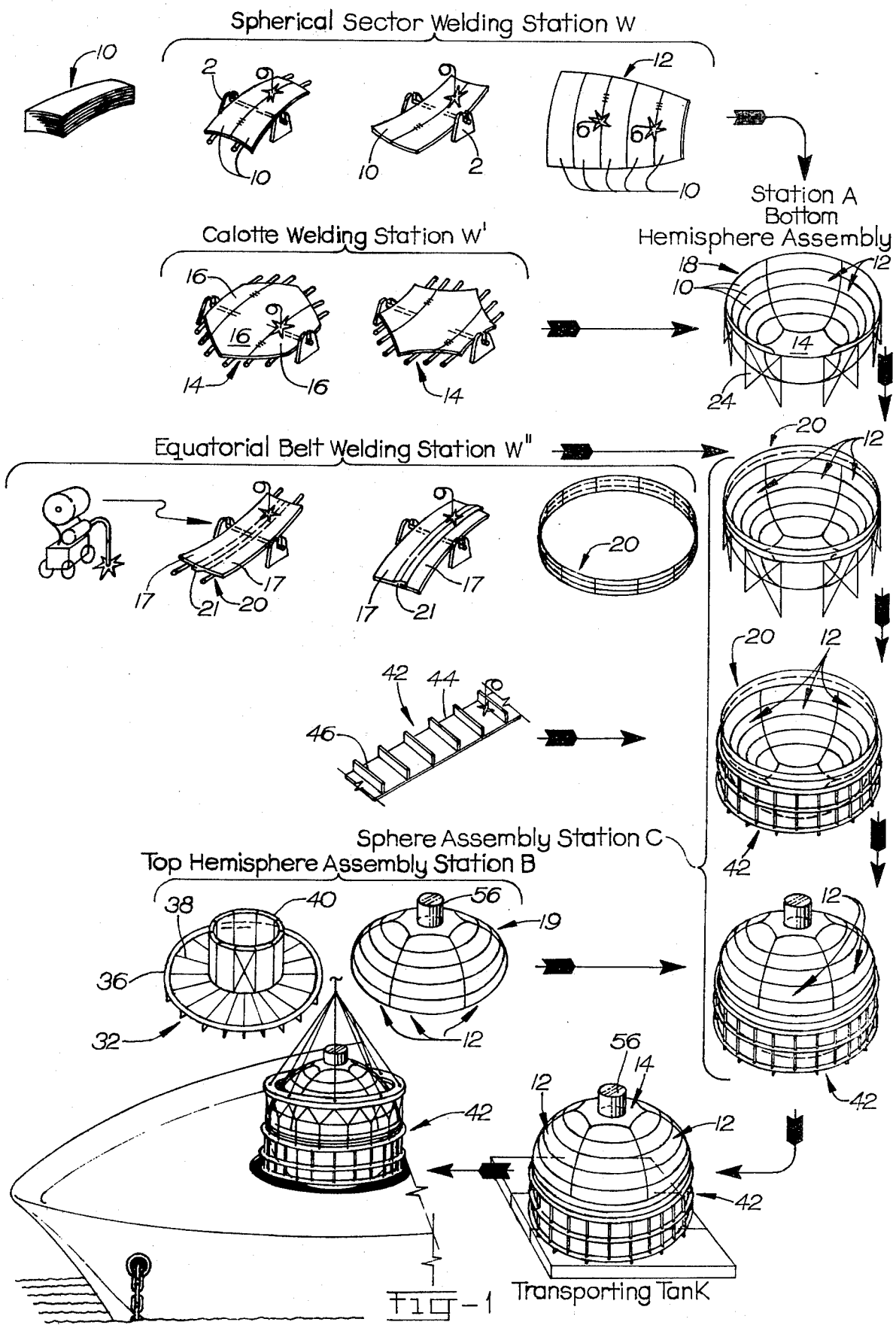
FIG. 1 is a manufacturing process flow chart depicting schematically the principal steps involved in fabricating and assembling the various components of a spherical tank produced in accordance with the invention including, in particular, the steps and stations used to assemble the hemispherical portions of the tank.
Figure 2:
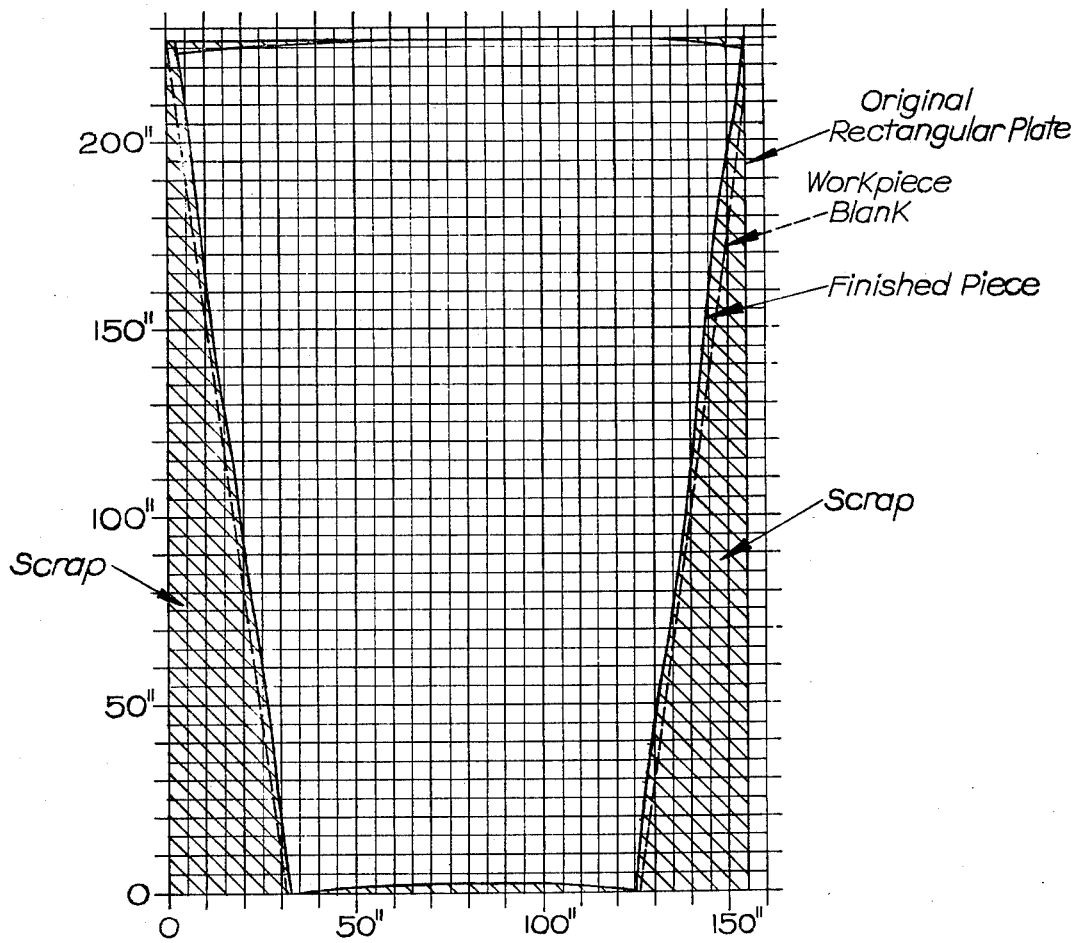
PRIOR ART FIG-2
FIG. 2 discloses the generally flat configuration of a typical elongated quadralateral plate member subsequently compoundly curved and presently used and longitudinally arranged in the construction of the lower hemispherical portion of a standard spherical tank, with the relatively large amounts of scrap that result due to the trimming, cutting and fitting required to integrate the same in the tank's structure being shown in outline.
Figure 2A:
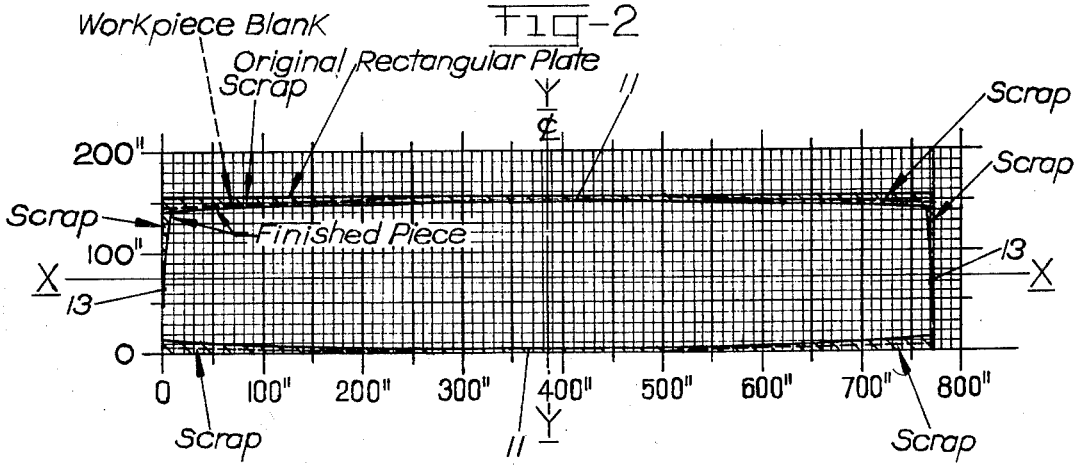

With further reference to the drawings, and particularly as shown in FIG. 2(*a*), the individual elongated, curvilinear and latitudinal-type metal plate members 10 of the instant invention have varying lengths and thickness relative to each other but substantially the same dimensional width when measured along the length of the minor axes Y and at the midpoint of the major axes X thereof. It is also to be understood that the aforesaid same minor and major axial dimensions are substantially retained when those same axes are curved in accordance with the compound curvature assumed by the finally pressed plate members used in the finished tanks. Plates 10 which can be made of a suitable aluminum alloy are compoundly curved in appropriate presses and welded together into hemispherical and somewhat truncated triangular sectors 12 at the spherical sector welding station W of FIG. 1. In a preferred embodiment of the invention, the above plate dimensional width should closely approximate the original as-rolled flat plate width of all the plate members to maximize efficiency of metal usage and minimize scrap loss. This plate width, of course, will be calculated in accordance with the overall dimensions of the spherical tank to be constructed and the desired spacing of the latitudinal great circle arcs of the finished tank. While the hemisphere formations will be discussed with particular reference to the hexagonal designs or patterns of FIGS. 7 and 7(*a*) and the octagonal patterns for the hemispheres of the sphere of FIGS. 8 and 8(*a*), it is to be understood other polygonal patterns can be used depending on the specific spherical tank structure desired.

It may be noted, moreover, that large size hemispheres of octagonal sector design permit excellent scrap savings because among other things such sectors can make use of metal plates having dimensions that are readily commercially available. Thus, FIGS. 2 and 2(*a*), respectively, illustrate typical prior art metal aluminum plates and plates of the instant invention that can be used to material advantage in the construction of the major hemispherical parts of a spherical LNG tank having an octagonal hemisphere sector pattern as in FIGS. 8 and 8(*a*) and a spherical diameter on the order of about 120 feet. This same tank has plate thicknesses on the order of about two inches at the equator and polar regions and plate thicknesses that vary between one and two inches intermediate the equator and polar regions. For a sphere of the aforesaid diameter, an individual prior art finally curved metal hemisphere plate of FIG. 2 would have in its initial flat condition a dimensional width on the order of about 154" at the top, a dimensional width of about 93" at the bottom and a tapering cross-sectional thickness along its major axis or plate length which length is on the order of about 229". In contrast, the plate of FIG. 2(*a*) has a calculated initially flat and later curved major axis X length on the order of about 772" and an initially flat and later curved minor axis Y dimensional width on the order of 154" when measured across the midpoint of the initially flat and later curved major axis X and a relatively uniform thickness from end marginal edge 13 to end marginal edge 13. The longer plate of FIG. 2(*a*) also makes for more efficient surface coverage per plate and less plates per sphere than the plates of FIG. 2.

The large amount of scrap per individual plate generated by use of the prior art longitudinally oriented spherical plates as compared to that generated by use of the latitudinally oriented plates of FIG. 2(*a*) is graphically illustrated by a comparison of the plates of FIGS. 2 and 2(*a*). FIG. 2(*a*) indicates that each plate 10 used in a triangular sector 12 of the instant invention will have the same relatively small amount of scrap loss at the four corners and better uniformity as to width than the plate of FIG. 2 regardless of its length. The width of this same plate 10 measured along the short axis Y and at the midpoint of the long axis X will also remain substantially constant during cutting and trimming, etc. When the scrap material per plate is multiplied by the number of hemispherical plates used per sphere it will be obvious that substantial scrap savings are involved in the use of the instant invention plate of FIG. 2(*a*). In the case of a spherical tank having the octagonal designs of FIGS. 8 and 8(*a*) and the above noted 120 foot diameter, it is estimated that use of the instant invention and the plates of FIG. 2(*a*) will reduce the scrap losses about one-half.

Figure 7A:
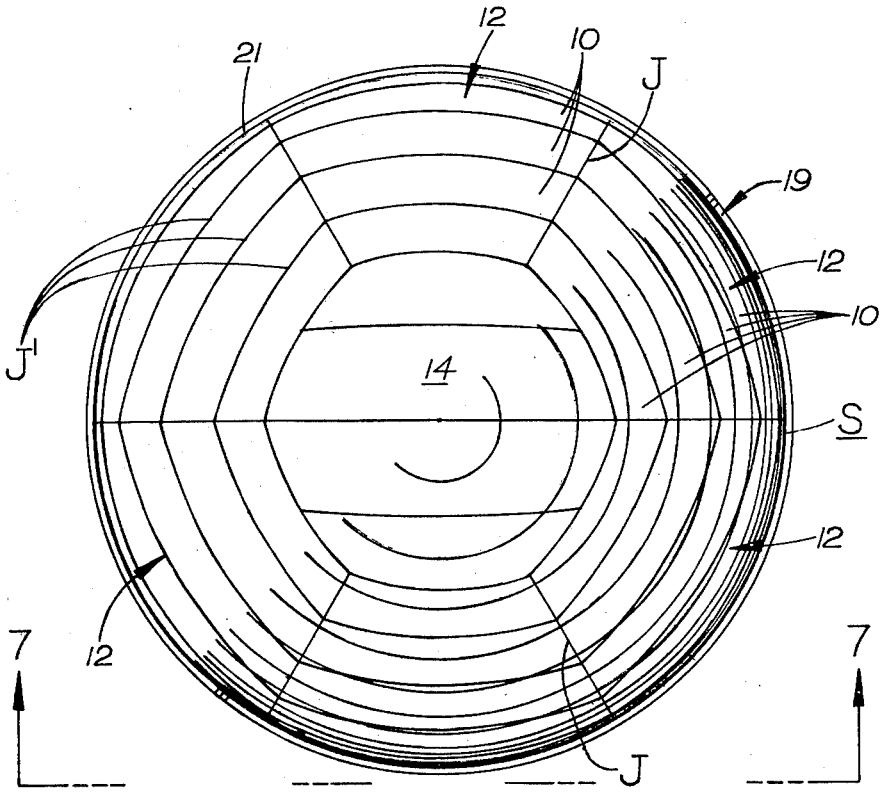
FIGS. 7 and 7(*a*) illustrate a typical spherical tank fabricated by use of the method of the instant invention wherein the individual top and bottom hemispheres comprise hexagons made up of symmetrical triangular sections and with FIG. 7 comprising a view taken along line 7—7 of FIG. 7(*a*)
Figure 7B:
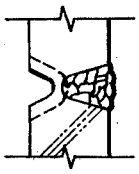
Figure 7:
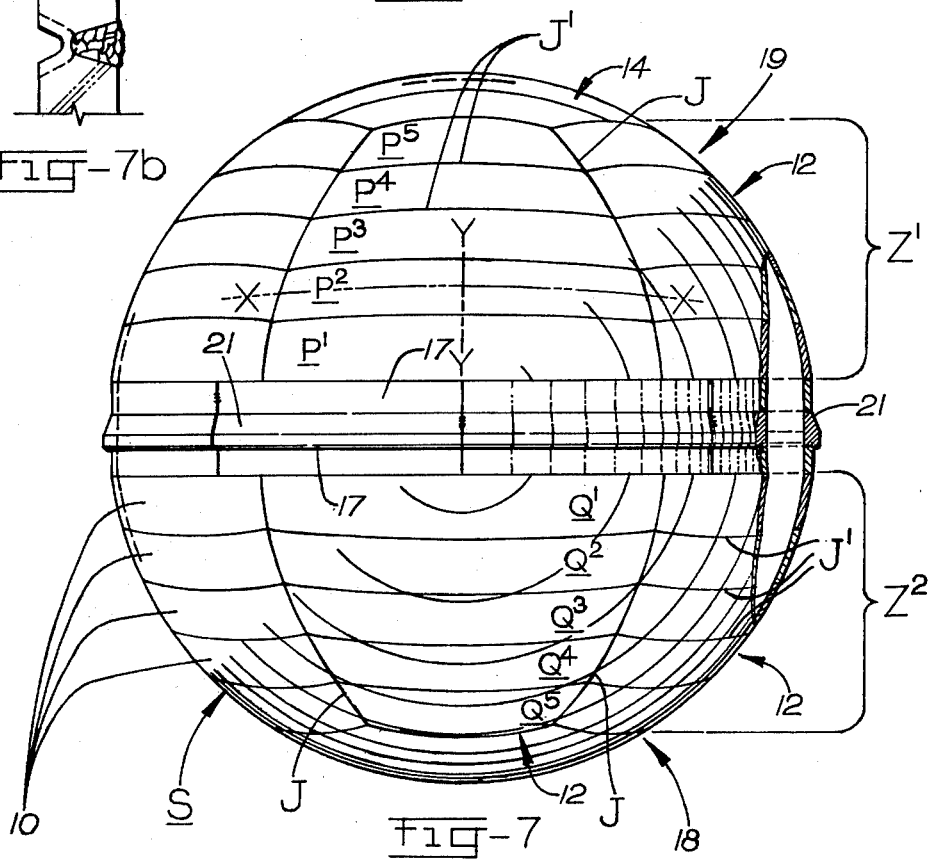
Figure 7C:
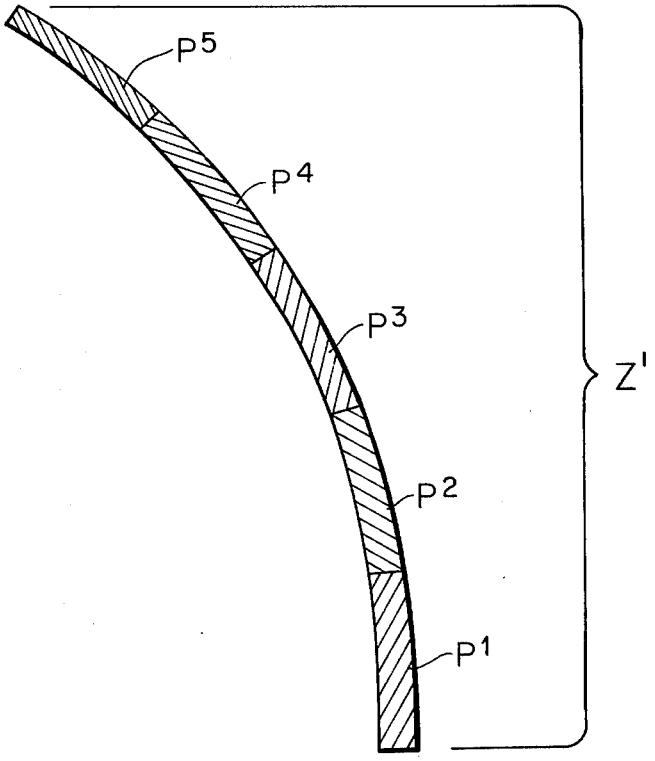
Figure 8A:
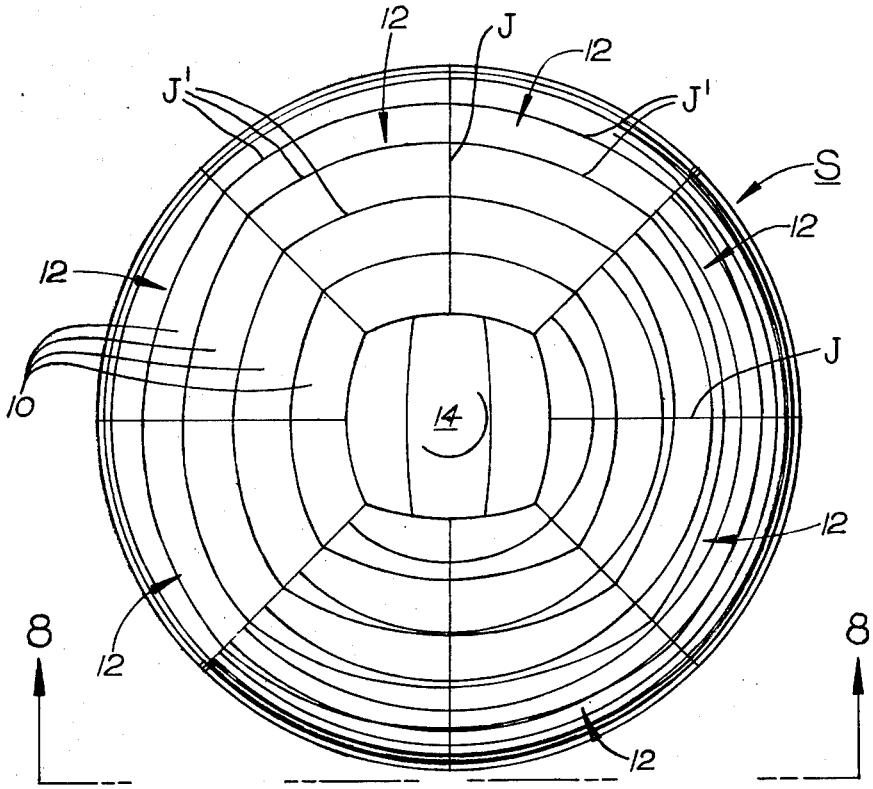
FIGS. 8 and 8(*a*) illustrate a modified sphere and show how the hemispheres of a tank can be so fabricated from metal plates so as to form octagonal patterns and with FIG. 8 comprising a view taken along line 8—8 of FIG. 8(*a*)
Figure 8B:
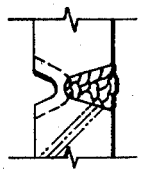
Figure 8:
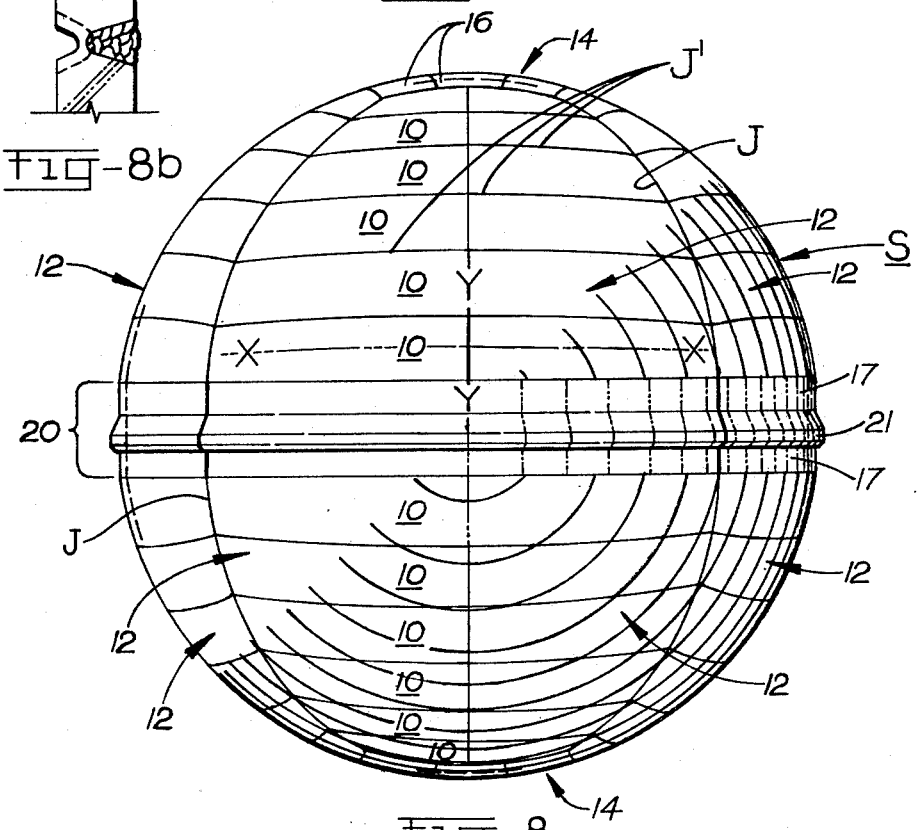

As indicated in FIG. 1, the several metal plate members 10 of a sector 12 can be first welded together in pairs along one full sector side such as by one of the conventional double U-welds of FIG. 8(*b*) and by means of conventional Metal Inert Gas (MIG) welding equipment as discussed in the article by P. Takis Veliotis. Thereafter, each pair of sector plates is reversed as a unit on the welding jig or fixture 2 and then welded on the other side by way of the second weld of the double weld of FIG. 7(*b*). After several pairs of plates are welded, the pairs are welded together and to a further plate.

It is to be understood, of course, that prior to sector assembly and welding, in accordance with standard practice, the marginal side and end edges 11 and 13, respectively, of the various plates 10 will have been properly cut, trimmed and beveled to provide the desired tapered surfaces adjacent the weld areas preparatory to welding, and also back-routed in the same areas during welding in accordance with normal welding procedures.

During the welding together of the individual quadralateral plate members 10 into triangular sectors 12, the plate members will be normally arranged such that the longest and thickest plate 10 will be located at the bottom of its respective sector 12 so as to be ultimately located closest to the equatorial region in the finished tank. In this connection, it is to be observed that even though the width of all plate members 10 when measured at the major axis midpoints thereof as noted is substantially the same, the various plate members will normally have different as-rolled thicknesses depending upon their particular location on the sphere. Each plate member as such, however, can and will normally have a substantially uniform thickness from one of its end edges 13 to the other end edge 13.

The above sector plate assembly is in accordance with the procedure of using the thicker plates at the equatorial and polar regions of the sphere because of strength requirements and the thinner plate members in between. In addition, the intermediate plates in the bottom or lower hemispherical portion of the sphere are somewhat thicker than those in the top portion, and they may all be thicker than the thickest bottom plate in a given sector of the upper hemisphere of the tank.

Thus, for example, with reference to FIGS. 7 and 7(*a*), the lowest plate P′ of a sector 12 in top zone Z′ of the sphere of FIG. 7 of certain given overall dimensions can have a substantially uniform thickness from end edge 13 to end edge 13 of about 1.220″; plate $P^2$ a uniform thickness of about 1.220″; plates $P^3$ and $P^4$ a uniform thickness of 0.866″; and plate $P^5$ a uniform thickness of 0.866″.

In contrast, the topmost plate Q′ of the corresponding sector 12 in the lower hemisphere zone $Z^2$ of the sphere of FIGS. 7 and 7(*a*) can have a uniform thickness from end edge 13 to end edge 13 of about 1.693″; plate $Q^2$ a uniform thickness of 1.693″; plate $Q^3$ a uniform thickness of 1.654″; plate $O^4$ a uniform thickness of 1.654″; and plate $O^5$ a uniform thickness of 1.693″. The same thicknesses as noted above prevails for all similarly hemispherically and latitudinally located plates in the sphere of FIGS. 7 and 7(*a*). This arrangement provides for substantially overall uniformity in the thickness of a given layer or level of plates in the upper and lower hemispherical parts of the tank even though the counter part plates in opposing hemispherical levels or parts of the spherical tank may have different thicknesses relative to each other. The plates can also be slightly tapered-beveled along their marginal side edges, prior to assembly, to bring about proper matching as to thickness if required by the various regulatory or design agencies involved.

Contemporaneously with the formation of the spherical triangular sectors 12, and in order to have a smooth flow of work, a secondary welding operation may take place at welding station W′. At welding station W′, the various curvilinear plates 16 also of a suitable aluminum alloy which have been previously cut and press-formed to selected dimensions and curvatures are assembled and welded into what is designated as a polygonal polar cap or calotte 14, one for each of the polar areas on the sphere. The individual plates 16 making up a calotte 14 will ordinarily have a greater thickness than the plates located between the equatorial region and the polar areas because of the loads carried by the same in the finished tank in which they are incorporated. Calottes 14 can have various compoundly curved configurations. For example, they can be made in the shape of hexagons, octagons, or pentagons, depending upon the designated number of spherical triangular sectors which are to be employed for the tank hemispheres. Thus, the calottes for the sphere S of FIGS. 7 and 7(*a*) can be curvilinear hexagons when the sphere S is made up of hexagonal hemispheres 18 and 19. In any event, regardless of the particular polygonal configuration or sector arrangement which is employed, the calotte plates 16 are welded together by appropriate fixtures in the manner indicated in FIG. 1, after the edges have been previously beveled and brought together, etc. The same MIG welding procedure can be employed to weld the calotte plates as previously described with respect to the individual plates 10 making up a spherical triangular sector 12.

It is further contemplated, as indicated in FIG. 1, in a preferred method of assembly of the instant invention, that the aluminum alloy preformed and compoundly curved members 17 used in the equatorial belt 20, be welded together at a further welding station W″ at the same time the other welding and tank assembly operations take place. In the event, as indicated particularly in FIGS. 1, 5, and 5(*a*), the equatorial belt 20 is to include an intermediate, aluminum alloy, equatorial ring 21 for the purpose of anchoring or securing the sphere S on board ship, the various work holding jigs and fixtures at welding station W″ will be properly adjusted to accommodate and weld such a ring to the adjacent plate members 17. Plate members 17 and ring 21 can be welded to each other by the same double MIG welds of FIGS. 7(*b*) and 8(*b*) previously described. Ring 21 can take the form of the ring shown in FIGS. 5(*a*) and 10 or the double legged ring shown in U.S. Pat. No. 3,841,269 depending upon the exact type of spherical tank installation and steel-aluminum transition joint attachments that are to be used for securing the spheres in place on board ship.

After the various triangular sectors 12 along with the two polar calottes 14 and the equatorial belt 20 have been fabricated in accordance with the procedures outlined above, these components of the sphere S are then adapted to be assembled together at what can be referred to as Bottom Hemisphere Assembly Station A and Top Hemisphere Assembly Station B.

Welding the various individual plate elements 10, 16, 17 and 21 in the manner and patterns described to make up the major components of the sphere S, such as sectors 12, belt 20 and calottes 14, means that such welding can at least for the most part take place while the individual plate elements assume a generally overall flat welding position. This flat disposition of the plates permits the plate members 10, 16, 17 and ring 21 to be more easily fitted and welded together into their respective sphere components and the welds themselves, due to the welding procedures involved, are less susceptible to flaws. Moreover, flat mechanical welding equipment and work holders are relatively uncomplicated as compared to the mechanical equipment required for welding the plates and sphere segments together in the vertical positions at the job site.

Figure 3:
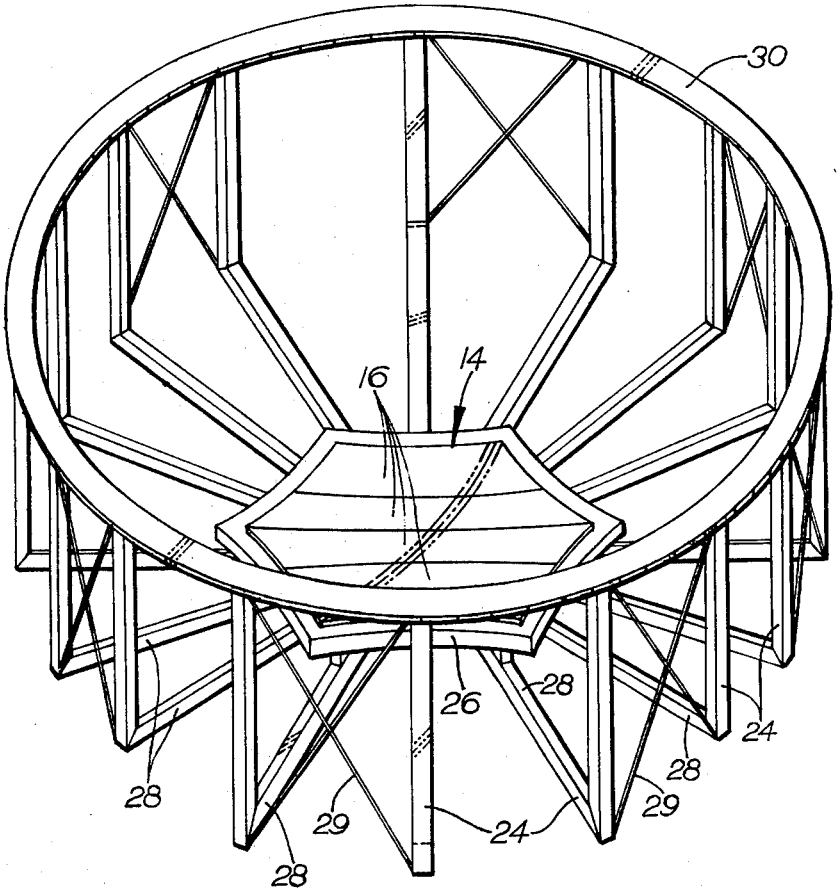
FIG. 3 is a schematic perspective view of a typical stadium-like jig assembly or fixture used for assembling the bottom hemisphere of a spherical tank made in accordance with the invention, with the bottom polar cap or calotte for the tank located in place on the usual leveling piers.
Figure 4A:
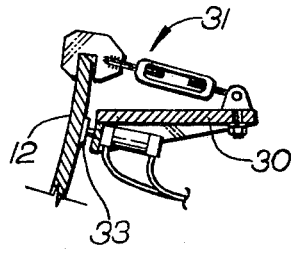
FIG. 4 is a further schematic perspective view of the bottom hemisphere assembly station illustrated in FIGS. 1 and 3 and discloses an assembled lower tank hemisphere in position for receiving an equatorial belt section.
Figure 4:
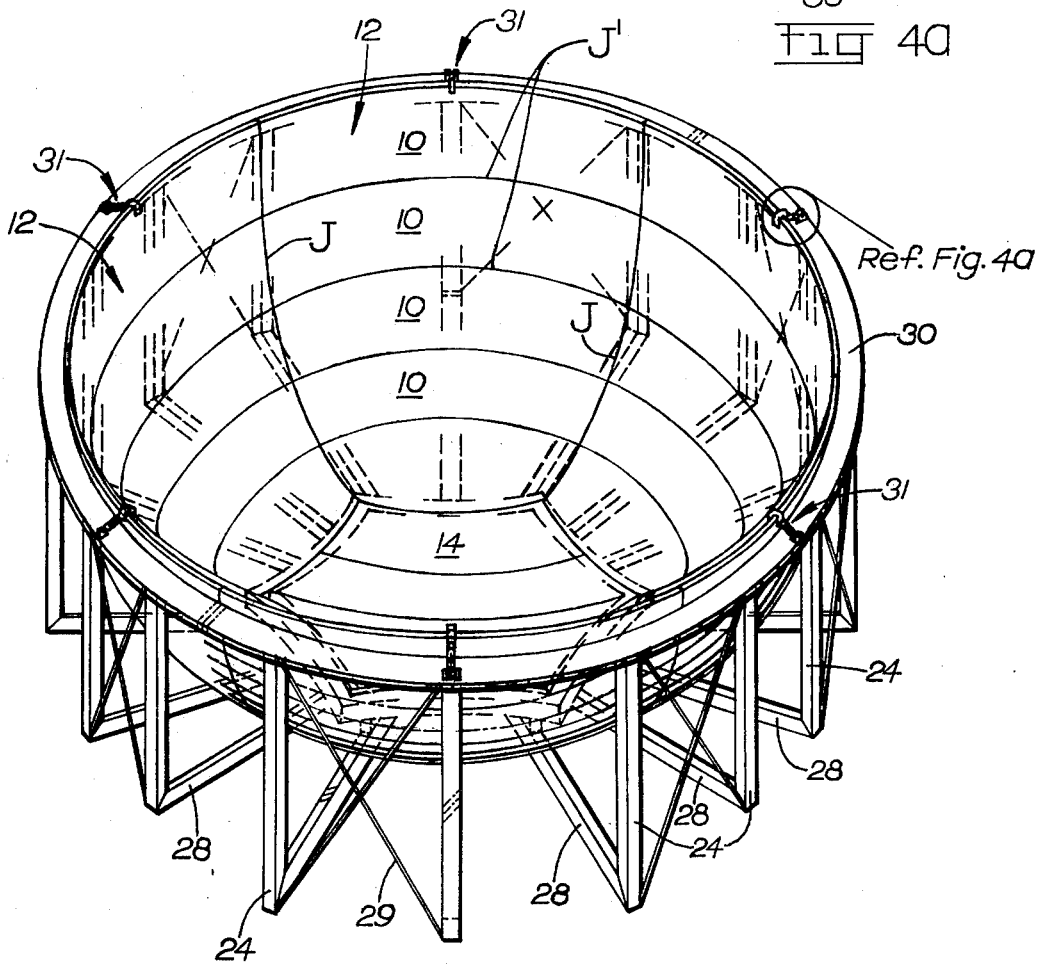

With further reference to the drawings and, in particular FIGS. 1, 3 and 4, it will be observed that the triangular modules or components making up the bottom hemisphere 18, such as the sectors 12 and bottom calotte 14 and, are all brought together for final assembly at Bottom Hemisphere Assembly Station A. This station generally includes a series of radially disposed support legs or stanchions 24. Legs 24 are connected to a suitably configured bottom calotte platen 26 supported by leveling piers or other similar devices (not shown) by means of the horizontal leg extensions or braces 28. Legs 24 are reinforced by cross ties 29 and connected at their upper extremities to ring fixture 30 for the purpose of supporting this fixture. Bottom Hemisphere Assembly Station A includes other conventional reinforcing gusset and plate members, etc., (not shown). As shown in FIG. 4(*a*), ring fixture 30 of Assembly Station A is fitted with a plurality of appropriate C-clamps 31 for engaging the endmost plate of a triangular sector 12 and a pneumatic or hydraulically operated sector support plate 33. Clamps 31 and plates 33 can be located at 60° intervals along ring fixture 30.

The bottom calotte platen or support 26 has the appropriate curvature for receiving the bottom polar calotte and an overall hexagonal configuration since it serves as the polar cap for the sphere S of FIGS. 7 and 7(*a*). With the lower calotte 14 in place, the various sectors 12 of the bottom hemisphere 18 can then be assembled. While using the standard MIG welding techniques previously described, sectors 12 are permanently joined to each other at Bottom Hemisphere Assembly Station A along the longitudinal seams or joints J located along the longitudinal great circle arcs that outline the hemispherical hexagons and intersect when fully projected across the polar area of the lower hemisphere and along the latitudinal joints J′ located along great circle arcs between calotte 14 and sectors 12 and the plates 10 thereof.

A preferred embodiment of the invention contemplates that, at the same time, the curved short or end marginal edges 13 of opposing quadralateral plates 10 are abutted and welded together by the double welds of FIGS. 7(*b*)and 8(*b*) while being aligned with the great circle arcs of joints J, the curved side marginal edges 11 of the plate members 10 of adjoining triangular sectors 12 will also be brought into registry with each other such that they will all be aligned with the great circle arcs of joints J′ which intersect geodesic fashion with the arcs of joints J formed by the contiguous end marginal edges 13 of the respective triangular spherical segments or sectors 12.

After the several symmetrical triangular sectors 12 for the bottom hemisphere 18 have been welded to each other as well as to the bottom calotte 14 along weld lines J and J′, the bottom hemisphere 18 is ready for the installation and attachment of the equatorial belt 20. The upper half of equatorial belt 20 is advantageously included in the makeup of the bottom of the top hemisphere 19 while the bottom half of belt 20 forms part of the top of the bottom hemisphere 18.

Figure 5:
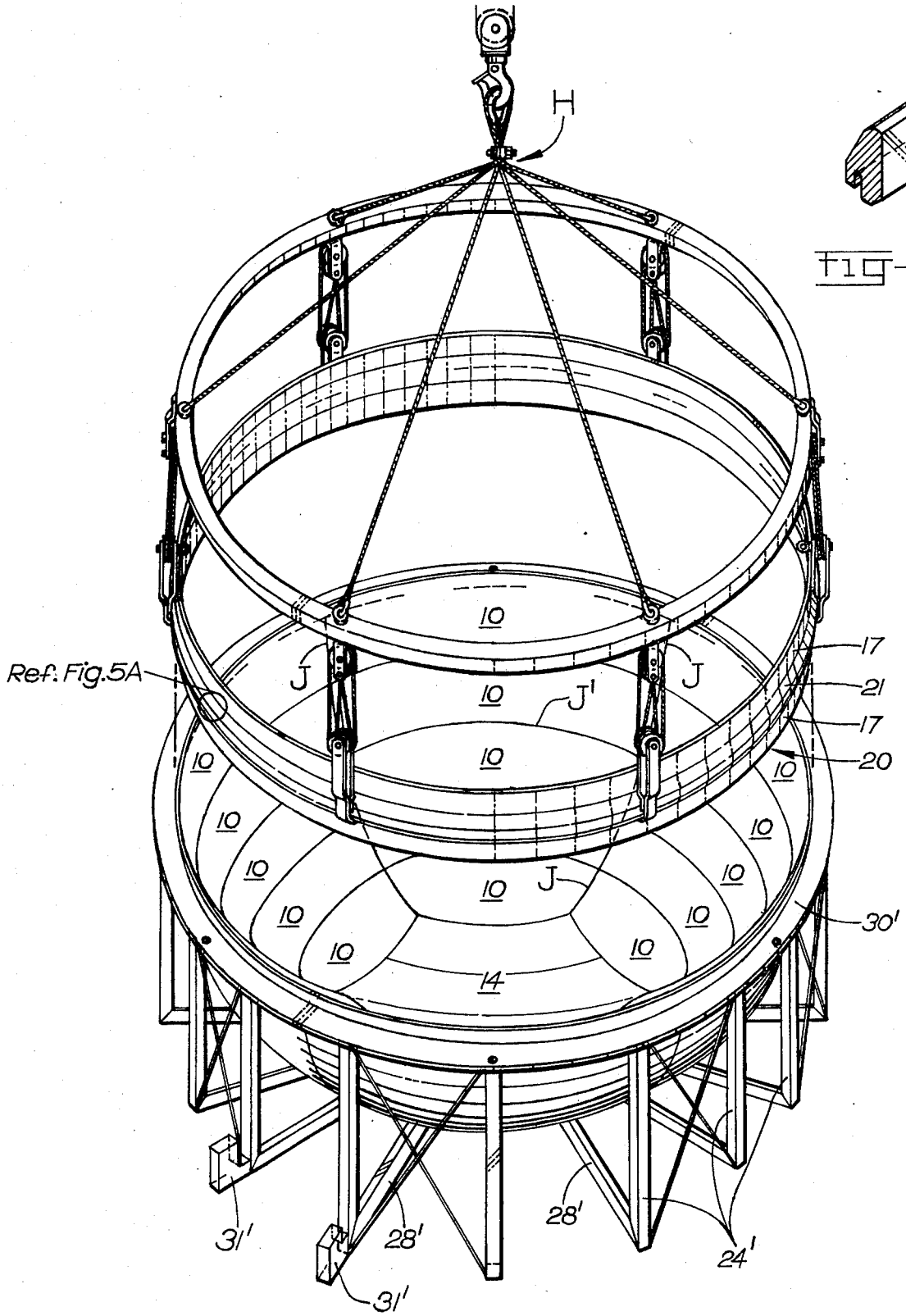
FIG. 5 is a schematic perspective view of a further bottom hemisphere assembly station at which the equatorial belt, an attachment skirt and top hemisphere are all affixed to the bottom hemipshere.

As indicated in FIGS. 8 and 8(*a*), one embodiment of the invention contemplates that the marginal end edges of the plate members 17 of the equatorial belt 20 and ring 21, when the latter is used, will be fitted, welded together and then oriented and welded relative to the various plate members 10 of the top and bottom hemisphere sectors 12 such that the various end edges of all plate and ring members in the belt 20 will be aligned with and from continuations of various common joints J that are coincident with the vertical longitudinal great circle arcs that outline the hemispherical octagons in the sphere S. As indicated in FIGS. 1 and 5, after equatorial belt 20 is assembled at welding station W″, it can be transported by a hoist H to Sphere Assembly Station C shown in FIGS. 1, 5 and 6. Belt 20 can then be assembled to the lower hemisphere 18 along with upper hemisphere 19 which has been previously moved to Station C by a hoist (not shown) for its final affixation to the lower hemisphere 18.

As in the case of Station A, Assembly Station C comprises vertical support legs 24′, horizontal extensions 28′, a polar or calotte support (not shown) and a support ring 30′. Unlike Station A, Station C also includes the radial leg extensions 31′, only two of which are shown, for supporting the skirt 42 to be affixed to the bottom hemisphere 18.

At the same time that one set or series of spherical triangular sectors 12 are being assembled into the lower hemisphere 18 along with equatorial belt 20 at Sphere Assembly Station A, a further series of triangular sectors 12 are undergoing assembly at Top Hemisphere Assembly Station B provided with the appropriate welding jigs and fixtures. These jigs or fixtures are schematically shown in FIG. 1, and overall can comprise a somewhat hat-shaped structure 32 provided with an outer peripheral sector supporting ring 36 upon which the bottom edges of the upright spherical sectors 12 are adapted to rest during the time they are welded to each other. Ring 36 is joined by the radial spoke members 38 to an upstanding annular framework 40. Framework 40 can be equipped in the usual fashion with sector supporting and aligning jig and fixture elements (not shown) for receiving the individual spherical segments 12 during the time that these segments are precisely fitted and welded together to form the upper hemisphere 19 for the sphere S. After its assembly, the upper hemisphere 19 is adapted to be transferred by a crane member (not shown) to Sphere Assembly Station C. This will usually take place, however, only after the ferrous metal attachment skirt 42 for the sphere S, used to finally mount and anchor the sphere S in a transport vessel, has been affixed to the equatorial ring 21 in the manner schematically indicated in FIG. 1.

Figure 9:
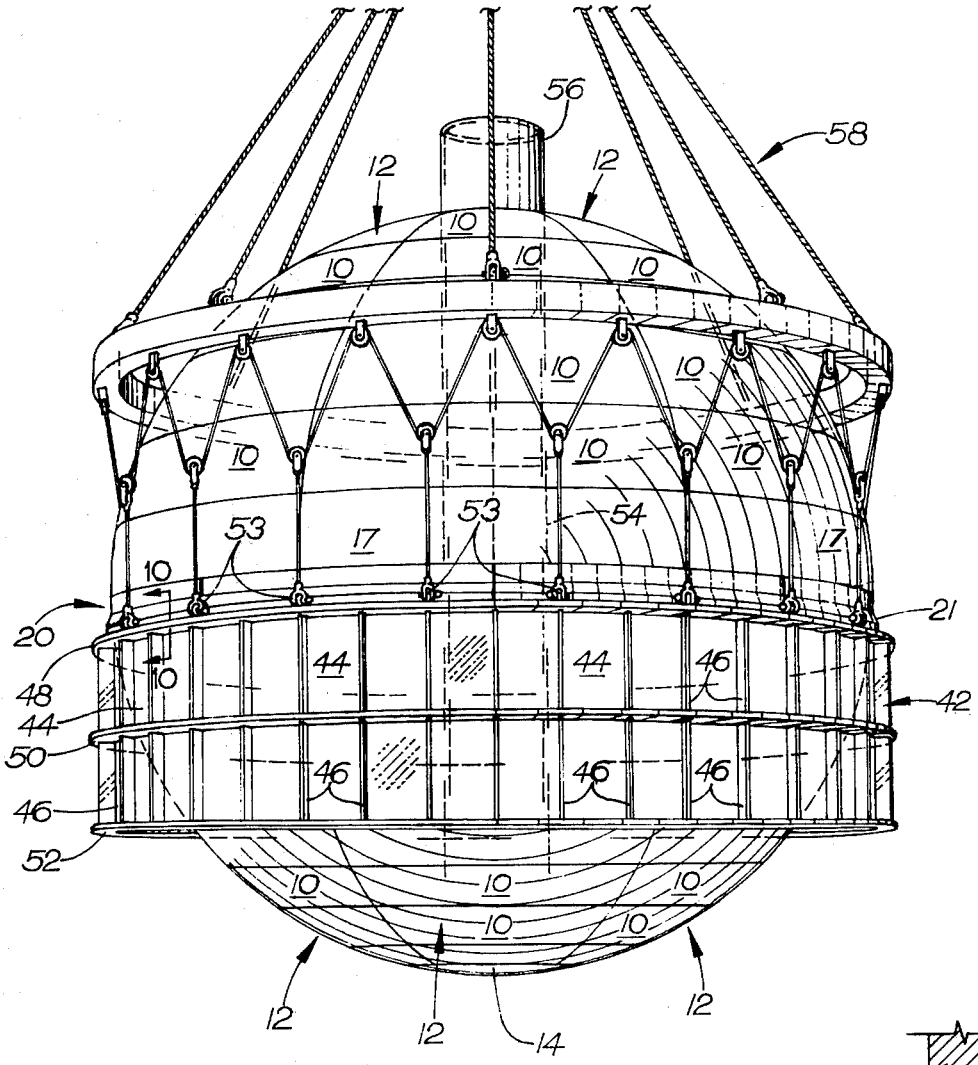
FIG. 9 is a perspective view of a finished skirted shipboard tank and a hoist therefor and shows how the tank can be lifted onto a vessel.

Skirt 42 supported on leg extension 31' at Station C is fabricated from a plurality of arcuate ferrous metal plating elements 44 of the appropriate thickness, metal composition, etc., welded together as well as to the transition section 45 of aluminum equatorial ring 21. Skirt 42 is reinforced by the vertical plates or gusset members 46 as well as the circular reinforcing rings 48, 50 and 52. The topmost ring 48 is provided with lifting rings or eyelets 53 which can be engaged by the pins, hooks or the like on the hoisting harness 58 shown in FIG. 9 when the finished sphere is finally hoisted and lowered into its station on board a LNG transport vessel.

Figure 10:
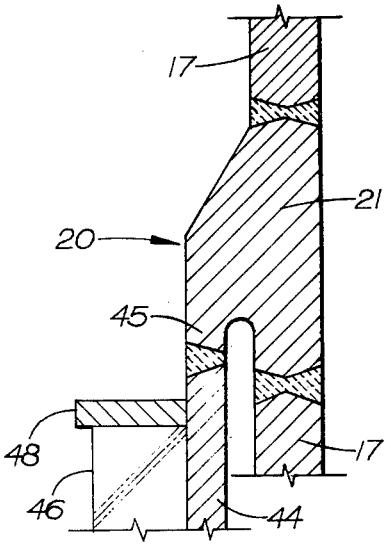
FIG. 10 is an enlarged sectional view taken along line 10—10 of FIG. 9.

A brief discussion of the function of skirt 42 is believed in order at this time. As indicated previously, the cryogenic sphere and the various segments and plates making up the equatorial belt, the individual triangular spherical segments and the polar calottes are all advantageously made from suitable aluminum alloys such as the Aluminum Association of America designated Alloy No. 5083-0 mentioned in the P. Takis Veliotis article. The reason for this is because aluminum is a metal along with stainless and special nickel alloy steels that will hold and store cryogenic material at the very low temperatures without becoming subject to brittleness failure as in the case of ordinary steel. Most transport vessels, however, are made of steel. Thus, the aluminum alloy equatorial ring for belt 20 must have a special transition-type section or member, e.g., section leg 45 formed integrally with the rest of ring 21 for connecting and integrating the aluminum sphere with the steel or ferrous metal hull of the transport vessel. This integration is appropriately effected such as by welding section leg 45 to the steel plating 44 of skirt 42 in the manner shown in FIG. 10. In this way the steel or ferrous metal of the ship's hull will not be brought into direct contact with the cryogenic liquid whereby it might be subject to embrittlement due to the low cryogenic temperatures.

Figure 6:
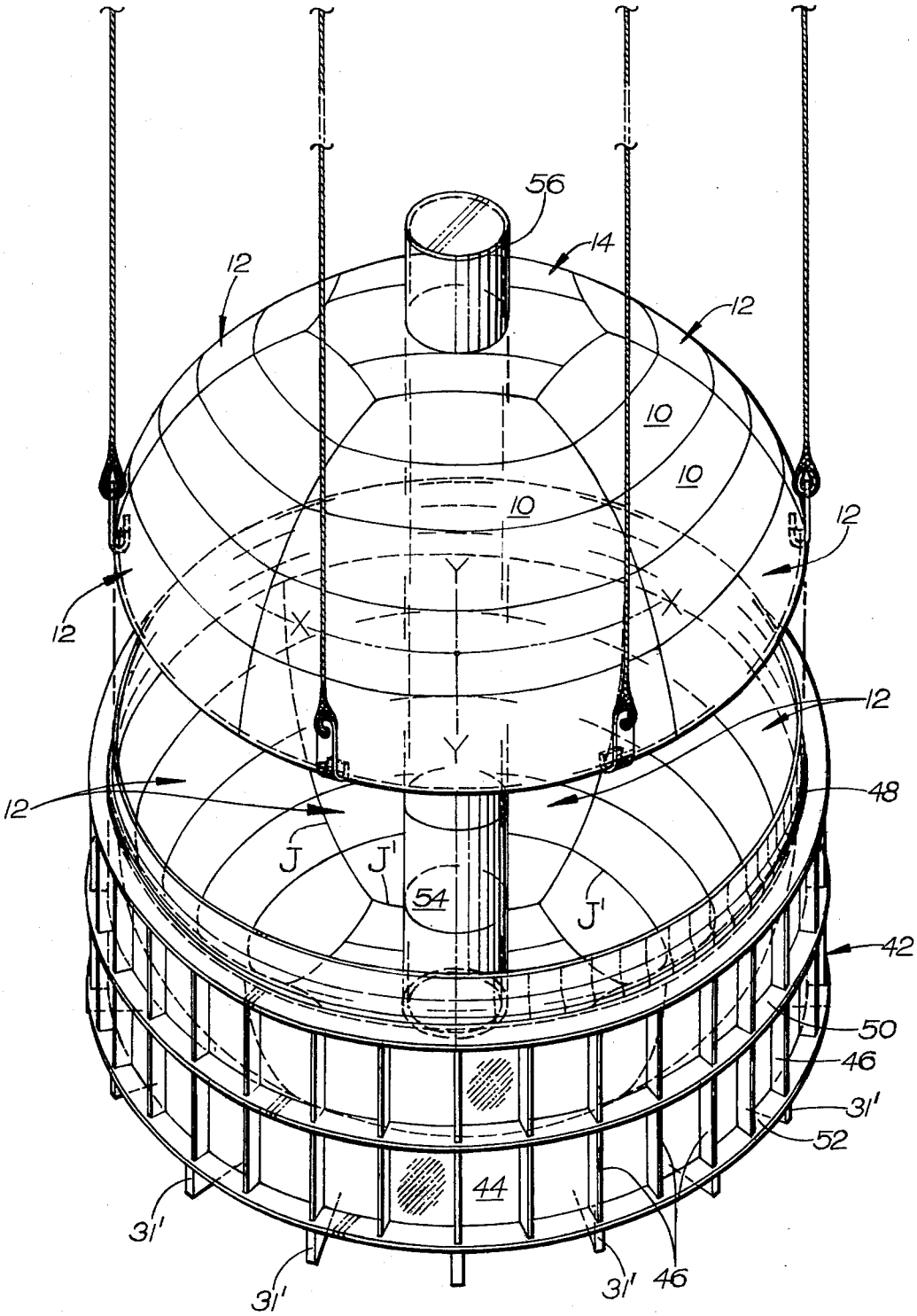
FIG. 6 is a perspective and somewhat schematic view of the sphere assembly station of FIGS. 1 and 5 showing the top hemisphere in the process of being lowered into place and into engagement with the bottom hemisphere and equatorial belt of the tank under construction.

After the skirt 42, structured as described, has been attached by welding in a manner well-known in the art to the transition part of ring 21 at Sphere Assembly Station C, the upper hemisphere 19 can be secured to the upper plate members 17 making up the equatorial belt 20 in the manner illustrated schematically in FIGS. 1 and 6.

Prior to the application of the upper hemispherical segment to the equatorial belt, in some installations, and as schematically shown, the central column or tower 54 that is used in the spherical tanks on board ship to contain the piping control, access ladders, etc., can be partially installed at Sphere Assembly Station C prior to the time that the upper hemisphere 19 is attached to the top of equatorial belt 20 to complete the tank construction. At the same time, the cap 56 for tower 54 can have been attached to the upper polar calotte 14 at the time the top hemisphere is fabricated at Top Hemisphere Assembly Station B. The type of welds which can be utilized to secure the upper hemisphere 19 to the plates of the equatorial belt can be the same double welds previously described. Upon assembly of the upper hemisphere 19 to equatorial belt 20, the spherical tank is complete and ready for final hydraulic and/or pneumatic testing for leaks and transportation to dockside and ultimate hoisting onto and installation on a LNG transport vessel.

From the foregoing, it will be now understood that the utilization of plates of varying lengths and thicknesses but of substantially the same dimensional initially flat and then final curved width when measured at the midpoint of the initially flat and then final curved major axis of the plate members in a substantial part of the tank structure will materially help in computerizing the overall construction of the spherical tank including the design, size, location and number of all components to be used. One can now take into account and full advantage of the location and orienting of the plates geodesically along the intersecting arcs of great circles. Utilizing for at least the majority of the hemispherical components in a given sphere an initially single width metal aluminum alloy plate also means that the plate rolling operations can be simplified since the same general width dimensions can now be efficiently and fully utilized.

Advantageous embodiments of the invention have been shown and described. Various changes and modifications can be made therein without departing from the spirit and scope thereof as defined in the appended claims wherein:

What is claimed is:

1. A spherical tank for liquefied natural gas and the like provided with hemispheres on opposite sides of the tank's equator, each of said hemispheres being comprised of a plurality of substantially symmetrical spherical triangular-like sectors, each sector being comprised of elongated quadrilateral plate members of compound curvature and having curvilinear marginal side and end edges and differing lengths, the longest plate member in a sector being located adjacent the equator of the tank and the remaining sector plate members being of progressively smaller lengths with the sector plate member of the smallest length being located adjacent a polar portion of the tank, the major axis and the side marginal edges of each of the plate members in a given sector all being located in generally parallel relation to each other and to the tank's equator, the curved minor axis dimensional width of each of said sector plate members in all of said sectors when measured at the midpoint of the curved major axis thereof being substantially the same, the top and bottom edges of the sectors in each hemisphere being substantially aligned, the number of sector plate members in each sector being equal, each plate member of one sector being substantially aligned with the corresponding sector plate members in each adjacent sector so as to form circular portions on the spherical tank parallel with great circles projected along the surface of the tank at a given longitudinal line, the sector plate members making up a given circular portion of the spherical tank all having substantially the same uniform thickness as well as substantially the same lengths along the major axis thereof and the midpoints of the major axis of the plate members in a sector also being in alignment, and the major axis of the sector plate members in all cases being larger than the minor axis.

2. A tank as set forth in claim 1 wherein the width of each sector plate member at the longitudinal midpoint thereof approximates the width of the same plate member in its as rolled condition.

3. The tank of claim 1 wherein each of the individual plate members of a sector has a substantially uniform thickness along its length but a different thickness relative to another plate member of the said sector.

4. The tank of claim 1 including means located in the equatorial area of the tank for securing the tank to a vessel.

5. The tank of claim 1 including polar caps secured to said sectors in the areas of polar convergence thereof.

6. The tank of claim 1 including polar caps secured to said sectors in the areas of polar convergence thereof, and said polar caps each being comprised of a plurality of plate members.

7. A spherical tank for liquefied natural gas and the like comprising the combination of an equatorial belt made up of a plurality of elongated compoundly curved plate members provided with curvilinear sides and ends, and hemispheres secured to opposing sides of said belt, the major axis of said plate members being aligned in combination to form a great circle about the longitudinal center axis of said spherical tank, each of said hemispheres in turn being comprised of a plurality of substantially symmetrical spherical triangularlike sectors, each sector being comprised of elongated quadrilateral plate members of compound curvature and having curvilinear marginal side and end edges and differing lengths, the longest plate member in a sector being located adjacent the equatorial belt and the remaining sector plate members being of progressively smaller lengths with the sector plate member of the smallest length being located adjacent a polar portion of the tank, the major axis and the side marginal edges of each of the plate members in a given sector all being located in generally parallel relation to each other and to the major axis of the plate members of the equatorial belt, the curved minor axis dimensional width of each of said sector plate members in all of said sectors when measured at the midpoint of the curved major axis thereof being substantially the same, the top and bottom edges of the sectors in each hemisphere being substantially aligned, the number of sector plate members in each sector being equal, each plate member of one sector being substantially aligned with the corresponding sector plate members in each adjacent sector so as to form circular portions on the spherical tank parallel with great circles projected along the surface of the tank at a given longitudinal line, the sector plate members making up a given circular portion of the spherical tank all having substantially the same uniform thickness as well as substantially the same lengths along the major axis thereof and the midpoints of the major axis of the plate members in a sector also being in alignment, and the major axis of the sector plate members in all cases being larger than the minor axis thereof.

8. A tank as set forth in claim 7 wherein the width of each sector plate member at the longitudinal midpoint thereof approximates the width of the same plate member in its as rolled condition.

9. The tank as set forth in claim 7 including polar cap means for each hemisphere of the tank.

10. The tank of claim 7 wherein an individual plate member of a sector has a substantially uniform thickness along its length but a different thickness relative to another plate member of said sector.

11. The tank of claim 7 wherein each of the individual plate members of a given sector has a substantially uniform thickness along its length but a different thickness relative to at least one other plate member of the said given sector and the thickest plate member of the sector being located adjacent the equatorial belt.

12. The tank of claim 7 wherein one plate member of a sector that is thinner than the thickest member is located adjacent a polar region of the spherical tank.

13. The tank of claim 7 wherein the equatorial belt also includes an equatorial ring provided with a transition section and a skirt attached to said transition section.

* * * * *